United States Patent [19]

Sinclair et al.

[11] Patent Number: 4,561,611

[45] Date of Patent: Dec. 31, 1985

[54] INFRARED TARGET SEEKER FOR SPINNING PROJECTILE

[75] Inventors: Ronald R. Sinclair, Moultonboro, N.H.; Theodore J. Nussdorfer, Lexington, Mass.

[73] Assignee: Sanders Associates, Inc., Nashua, N.H.

[21] Appl. No.: 392,713

[22] Filed: Aug. 10, 1973

[51] Int. Cl.[4] ..... F41G 7/22

[52] U.S. Cl. ..... 244/3.16

[58] Field of Search ..... 244/3.16, 3.17; 102/20.2 P, 213

[56] References Cited

U.S. PATENT DOCUMENTS

| | | | |
|---|---|---|---|
| 3,021,096 | 2/1962 | DeMott | 244/3.16 |
| 3,034,405 | 5/1962 | Biberman et al. | 244/3.16 |
| 3,065,931 | 11/1962 | Dixon et al. | 244/3.16 |
| 3,149,231 | 9/1964 | Ravich | 244/3.16 |
| 3,455,243 | 7/1969 | Martin | 244/3.16 |

*Primary Examiner*—Charles T. Jordan

*Attorney, Agent, or Firm*—Louis Etlinger; Richard I. Seligman

[57] ABSTRACT

An infrared target seeker for a spinning projectile which does not require any reticle motor or gimbals is provided by a solid unit including lenses, detectors and a reticle, which is etched on one of the lenses.

6 Claims, 14 Drawing Figures

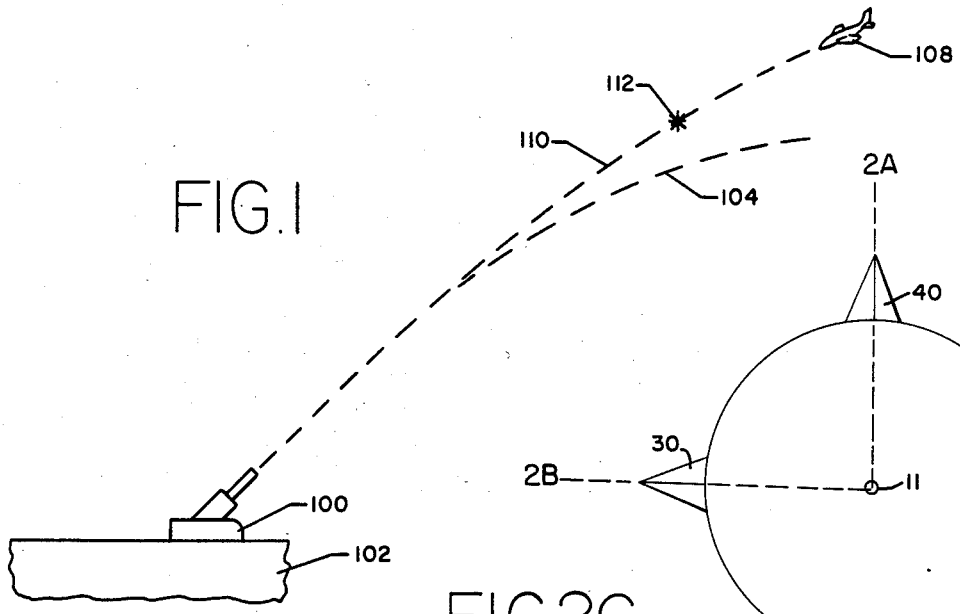
FIG.1
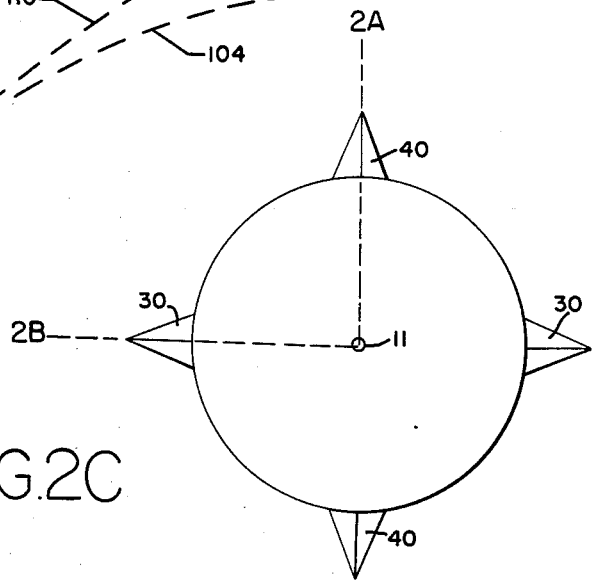
FIG.2C
FIG.2A
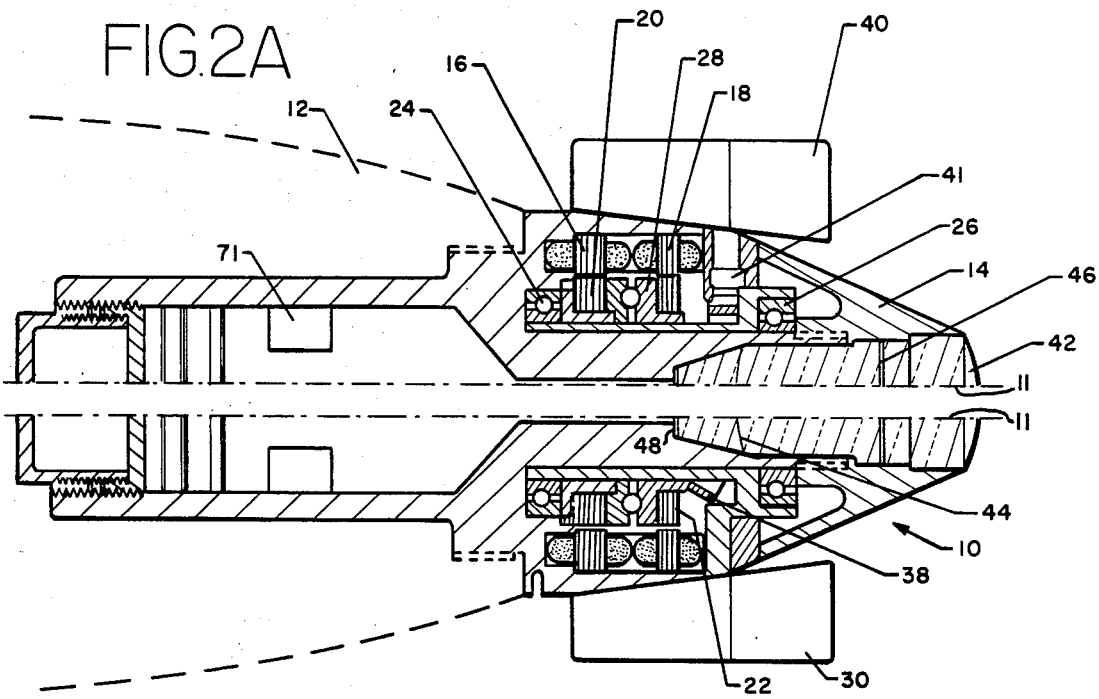
FIG.2B

FIG. 9
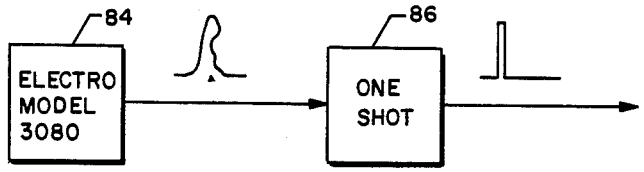
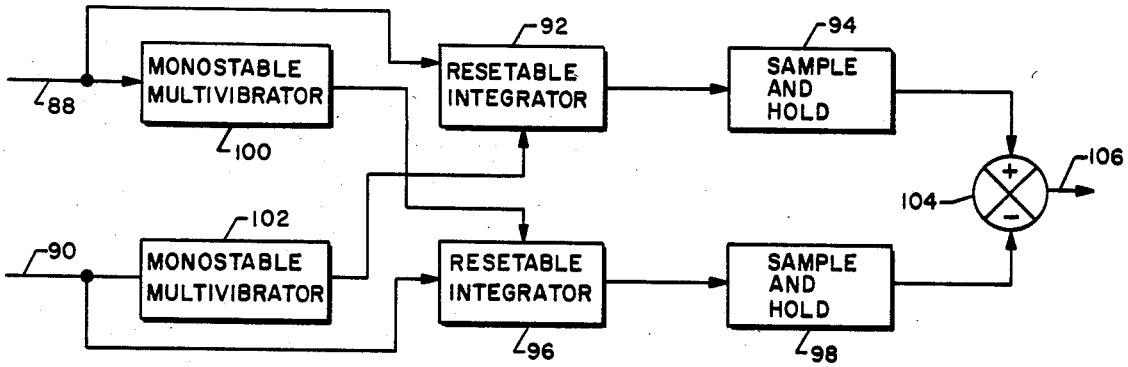
FIG. 10
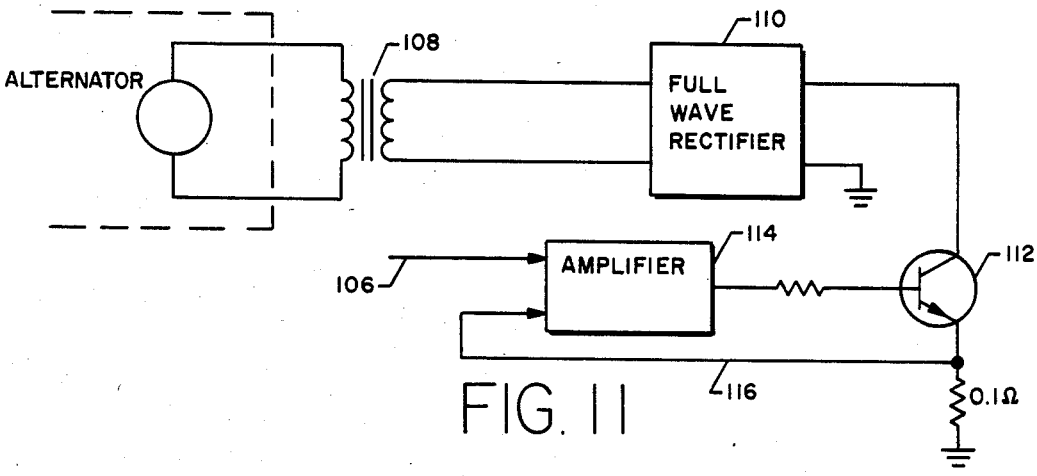
FIG. 11
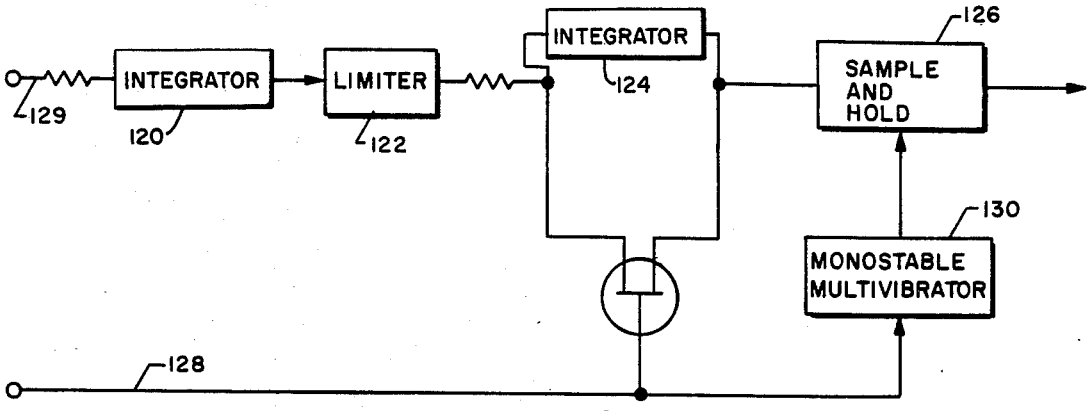
FIG. 12

INFRARED TARGET SEEKER FOR SPINNING PROJECTILE

BACKGROUND OF THE INVENTION

The present capability of gun fire-control systems for point defense against antiship missiles is limited by normal gun system errors and the number of projectiles that can be fired during a short engagement. For this reason guided missiles are used as a defense against antiship missiles. However, the effectiveness of such guided missiles is limited to a minimum range of several miles. Furthermore, they can be used only on specially equipped missile ships. The employment of antiship missile systems aboard a ship requires that major and expensive modifications be made to the ship or that the ship be particularly designed for the missiles.

One way of avoiding these problems and requirements is to substitute for the fuze on standard gun-fired projectiles a unit to provide terminal guidance to such projectiles. Because of size limitations it is necessary to limit the size of the components within the terminal guidance system. Also, the environment necessitates a rugged design. Conventional target seekers are relatively large since they require gimbals and a reticle motor and are, therefore, unsatisfactory for this purpose. Also, they would not survive the 20,000 g's shock of being fired from a naval cannon.

SUMMARY OF THE INVENTION

Accordingly, it is an object of this invention to provide a small, rugged infrared seeker for guided projectiles.

It is another object of this invention to provide an infrared seeker for a spinning projectile eliminating any need for gimbals or rectile motor.

Briefly, the above objects are achieved by providing in a spinning projectile a solid infrared target seeker or optical sensor comprising lenses, a reticle etched on one of the lenses and a photocell detector. The target seeker spins with the projectile to which it is attached thus not requiring a separate reticle motor. The target seeker acts as a fixed-body seeker and does not require a gimballed platform.

BRIEF DESCRIPTION OF THE DRAWINGS

The above mentioned and other features and objects of this invention will become more apparent by reference to the following description taken in conjunction with the accompanying drawings, in which:

FIG. 1 is a drawing illustrating the principles of a terminal guidance system for standard gun-fired projectiles;

FIGS. 2A and 2B are sectional views illustrating two different quarter sections of a terminal guidance system for a projectile;

FIG. 2C is a sketch illustrating the orientation of the cutting planes for FIGS. 2A and 2B;

FIG. 9 is a block diagram of means 58 of FIG. 6;

FIG. 10 is a block diagram of a comparator employed in FIG. 6;

FIG. 11 is a block diagram of an alternator and control therefor as used in the block diagram of FIG. 6; and FIG. 12 is a block diagram of the means 63 of FIG. 6.

DESCRIPTION OF PREFERRED EMBODIMENT

Figure 3:
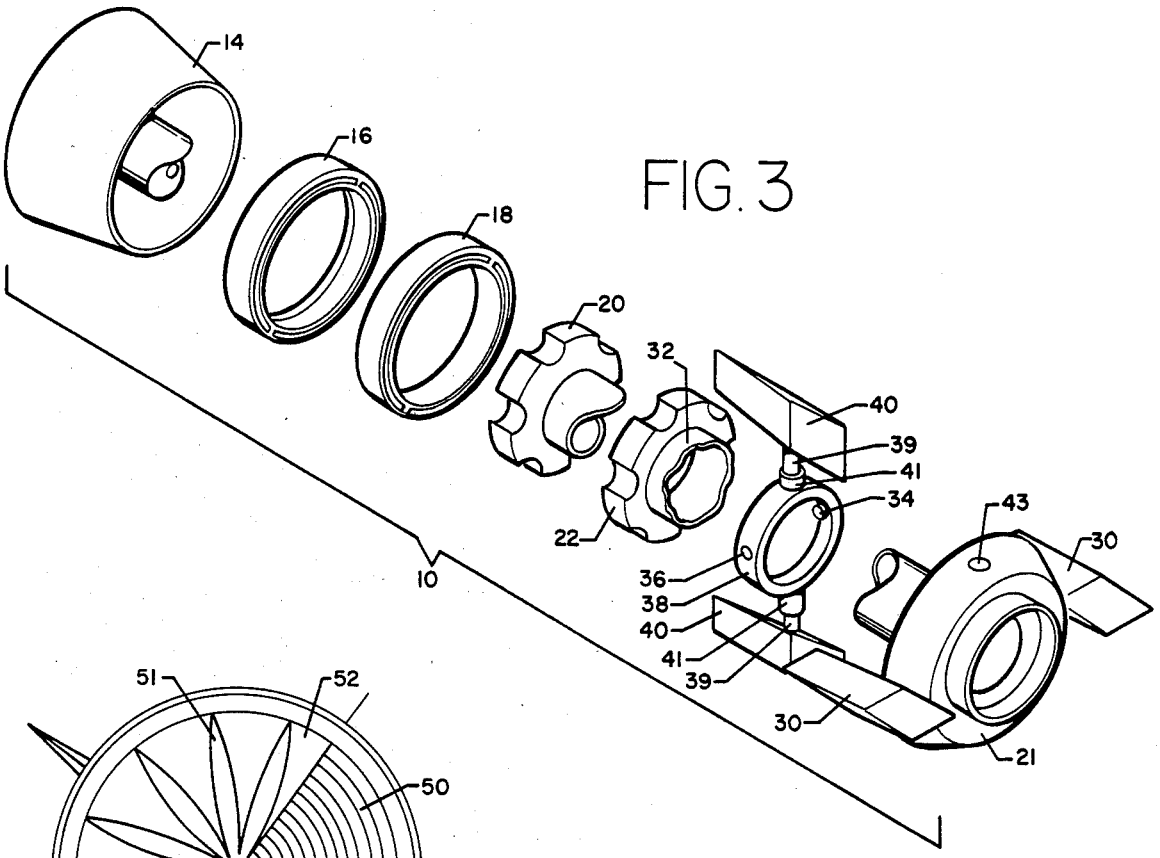
FIG. 3 is a perspective exploded view illustrating the major components of the terminal guidance system of FIGS. 2A and 2B.

The concept of providing terminal guidance for standard gun-fired spin stabilized shells is illustrated in FIG. 1 in conjunction with a ship board application. However, the concept is applicable for any gun-fired spin stabilized projectile whether land, sea or air launched. The projectile is a standard shell with the novel device substituted for the fuze and being threaded into the fuze well. The device has canards thereon to alter the trajectory of the shell.

The projectile is fired from a conventional gun 100 located aboard a ship 102. When fired, the shell travels along a trajectory 104. An optical sensor located in the front of the projectile detects the position of a target 108. Electronic signals generated proportional to the detected target position are processed and applied to the canard mechanism to alter the trajectory of the shell to a new trajectory 110 which will greatly improve probability of target intercept at position 112. More than one correction can be made during any single shell firing. Referring now to FIGS. 2A-2C and 3, there is illustrated thereby a preferred embodiment of the invention. FIG. 2A is a 90° cut through the center line 11 of the device and FIG. 2B is a 180° cut. The cutting planes are shown in FIG. 2C. The device 10 for providing terminal guidance to a ballistic projectile is a self-contained unit that threads into the fuze well of a standard shell 12. The device comprises a main housing 14 which when fired from a gun spins at the rate of the shell to which it is attached. Attached to main housing 14 are first and second sets of stator windings 16 and 18. These windings are press fitted therein or may be attached in any other convenient manner. Positioned in cooperating relationship with the sets of windings 16 and 18 are first and second rotors 20 and 22.

The rotor assemblies 20 and 22 are supported by a pair of bearings 24 and 26 also press fitted into the main housing. For clarity purposes the bearings are omitted in FIG. 3. A thrust bearing 28 positioned intermediate rotors 20 and 22 allows rotor 22 to rotate relative to rotor 20.

Attached to rotor 20 via a canard frame 21 are a pair of fixed canards 30. When the shell is fired from a gun the main housing 14 spins at the rate the shell is spinning while the air stream acts against the fixed canards 30 and a set of deflecting canards 40 to despin rotor 20 down to essentially zero RPM. In practice rotor 20 is actually made to spin in the opposite direction at a few RPM. If canards 30 and 40 were perfectly aligned with the rest of the device the air stream acting thereon would cause them to come to almost a complete stop. (There would be some spinning with the shell due to the load of the bearings, rotor, etc.). To cause the fixed canards to rotate in a direction opposite that of the main housing at a few RPM, a slight cant is put into the fixed canards (on the order of less than one degree). Bearings 24 and 26 permit the relative motion between the rotors 20 and 22 and the main housing 14, and, thus, the spinning shell.

The shaft of rotor 22 has a cam surface 32 thereon which cooperates with a cam follower, coupling pins 34 and 36. These pins are attached to a yoke 38 having a pair of deflecting canards 40 mounted thereon. In the example shown, the pins are spaced 180 degrees apart. Yoke 38 has a pair of shafts 39 attached thereto which ride in a corresponding pair of bearings 41. These bearings are disposed within holes 43 in the canard frame 21.

The difference in spin rate between stator windings 16 (attached to the main housing) and rotor 20 provides an alternator or generator whereby all the electrical power required by the device 10 is generated, thus, eliminating any requirement for external supply of power as, for example, from a batter or springs. This arrangement is different from conventional generators in that the stator windings are spun and the rotor kept relatively fixed. Conventionally, the stator windings are fixed and the rotor is rotated.

In addition to supplying prime power for the device, the windings-rotor combinations 16, 20 is also used to provide control for the canard frame 30. For this purpose, the windings-rotor arrangement 16, 20 is used as a motor in that the load on the windings 16 is varied, thus, permitting a controlled rate of rotation of the canard frame. The canard frame is rotated in order to align the deflecting canards 40 in a direction whereby they can be used to deflect the shell in the desired direction. The load on the windings 16 is continuously adjusted to maintain the proper (desired) orientation.

The deflecting canards 40 are controlled by a motor made up of windings 18 and rotor 22. The windings 18 rotate with the spinning projectile while the rotor 22 is despun. Guidance control signals applied to the windings 18 cause the rotor to rotate up to ±90 degrees with respect to the rotor 20. This action activates cam 32 that rotates the canard yoke 38 up to ±15 degrees around the canard hinge axis thereby deflecting the canards up to ±15 degrees.

In this arrangement prime power is generated and canard orientation and proportional deflection is achieved without any electrical or mechanical connections other than bearings between the spinning and despun sections.

The target seeker comprises a sensor 42 which is attached to the spinning projectile and, therefore, rotates therewith, thus eliminating any requirement for a separate reticle motor as in conventional infrared target seekers. The sensor 42 includes curved lenses, a reticle 44 etched on lens glass, a spectral filter 46 and a photocell detector 48.

The sensor is operated as a fixed-body seeker the error signal of which is electrically stabilized by the guidance system to eliminate the requirement for a gimballed platform. The optical design provides a wide field of view (12° half angle).

Preferably, the sensor is made to operate in a dual mode, that is, both in a passive infrared mode and a semiactive mode with a laser designator. For the dual mode application the detector 48 is a Si-PbS sandwiched detector. The PbS part of the sandwiched detector is used in the passive mode to track targets in the 2.0 to 2.5 micron band. The silicon part of the sandwiched detector is used in the semiactive mode to track targets illuminated by a laser designator. The silicon detector, transparent above 1.1 microns, detects the 1.06 micron, 200 watt CW signal transmitted from, for example, a ship and reflected off the target.

The sensor is a solid unit with individual components thereof cemented together so as to preclude any air gaps which would generate areas of high stress concentration at the acceleration levels which the device must withstand during firing.

Figure 4:
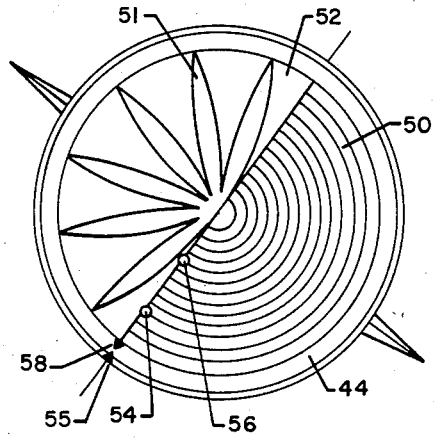
FIG. 4 is a plan view of a target seeker reticle employed in the assembly of FIGS. 2A and 2B and illustrating the use thereof for orientating and deflecting the canards.

One embodiment of reticle 44 is illustrated in FIG. 4. This reticle consists of two semicircles 50 and 52. Portion 50 is semitransparent while portion 52 includes a radial encoding design 51. The reticle encodes the polar-coordinate position of the target image with respect to the common spin axis of the projectile and the optical axis of the sensor. Operation with reticle 44 is described in conjunction with the waveforms of FIG. 5 and the functional block diagram of FIG. 6.

Figure 5:
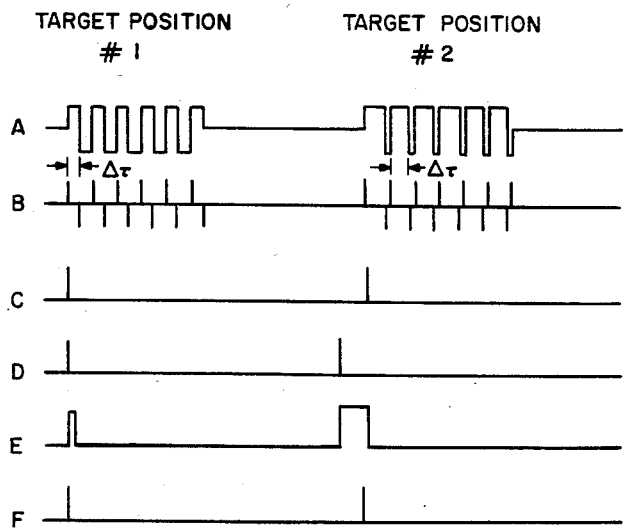
FIG. 5 is a series of waveforms illustrating operation of the target seeker.

When sensor 42 detects a target, detector 48 provides an output as shown in waveform A of FIG. 5. Note that two detected target positions are shown to illustrate how the signal changes depending upon target position. In actuality, only a single target is detected at any one time.

Waveform A indicates the target position with respect to the center line of the reticle. The pulses on the left of waveform A are from a target position 54 a relatively large distance away from the center of reticle 44 while the pulses on the right are from a target position 56 closer to the center of the reticle. By comparing the pulses of waveform A it is evident that the pulse width of the positive pulses increases as the target approaches the center of the reticle. This occurs since the portions 51 of the reticle section 52 predominate as the target nears the center of the reticle.

The pulses from a detected target as shown in waveform A of FIG. 5 are differentiated by differentiator 60 to provide the signal shown in waveform B. The first pulse of waveform B is shown in waveform C and designated the target reference pulse and coincides with the target entering the radial encoder sector of the reticle. The frequency of the target reference pulses equals the spin rate of the projectile referenced to the target.

A reference pickup 58 which may be, for example, a coil located on the main housing, generates a pulse each time the projectile rotates past the canard frame (see waveform D). Pickup 58 provides output each time it passes a magnet 55 located on the canard frame. Since, as mentioned hereinbefore, a small cant on the fixed canards causes the canard frame to rotate counterclockwise at a rate of 0 to 10 revolutions per second, the frequency of the reference pulses will equal the spin rate of the projectile plus the rotational rate of the canard frame. These reference pulses (waveform D of FIG. 5) have a slightly higher frequency than the target reference pulses (waveform C).

The frequencies of the target reference pulse (waveform C) and the canard reference pulse (waveform D) are compared to generate an error signal (waveform E). This error signal is used to increase the alternator load, thus slowing the rotational rate of the canard frame.

When the canard reference frequency is equal to the target reference pulse frequency (waveforms C and F), the error signal is zero, and the canard frame will be stopped with respect to the target.

The magnet 58 is located at the center line of one of the fixed canards and the reference pickup at the center line of the reticle so that when the canard reference pulse and the target reference pulse are coincident, the deflecting canards are oriented 90 degrees with respect to a plane containing the target line of sight. This is the correct orientation for correcting the projectile trajectory. The application of power to the canard deflection motor is the only operation remaining for starting the projectile trajectory correction.

Figure 7:
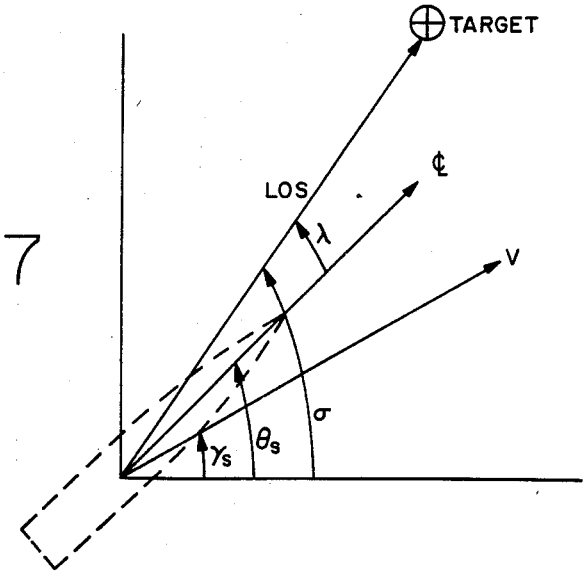
FIG. 7 is a diagram illustrating operation of the proportional navigation system.

The time interval between the positive and negative pulses from differentiator 60 are measured by unit 63. The six time intervals are averaged over one revolution of the projectile to attain a signal (time interval) that is directly proportional to the magnitude of the angle difference between the center line of the projectile (spin axis) and the line-of-sight of the target ($\lambda$) (see FIG. 7). The signal (analog voltage) resulting from the angle measurement is differentiated by differentiator 68 and smoothed by filter 70 to provide the look angle rate ($\lambda°$).

The look angle rate ($\lambda°$) is equal to $\sigma°$ plus $\theta°$ where $\sigma°$ is the line-of-sight rate in inertial space and $\theta°$ is the shell pitch rate or yaw rate in inertial space. In order to provide the inertial line-of-sight rate ($\sigma°$) the shell pitch rate or yaw rate ($\theta°$) must be subtracted from the look angle rate ($\lambda°$).

A rate gyro 71 having its spin axis perpendicular to the spin axis of the projectile provides $\theta°$ and the signal from the rate gyro is applied to a summer 72 along with $\lambda°$ to provide the difference signal $\sigma°$.

The difference output from summer 72 is amplified by an amplifier 74 and applied to windings 18 which deflect the deflecting canards 40.

What has been described with respect to the manner of deflecting the deflectable canards is a proportional navigation system wherein $\gamma°=K\sigma°$, $\gamma°$ being the rate of projectile flight path angle. The object of such a system is to drive $\sigma°$ to zero or, in other words, to maintaain $\sigma$. If $\sigma$ is maintained the projectile will hit the target.

Figure 6:
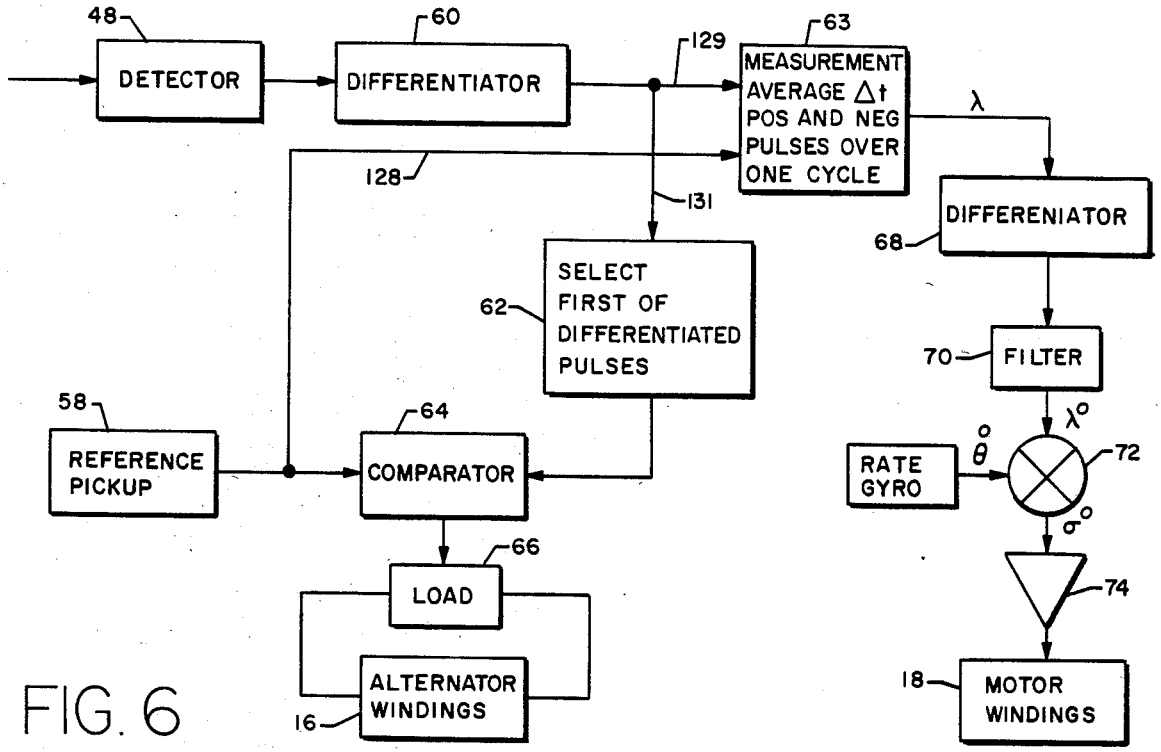
FIG. 6 is a functional block diagram of the electronics of the terminal guidance system of FIGS. 2A and 2B.

The functional blocks of FIG. 6 are now described in greater detail.

Figure 8:
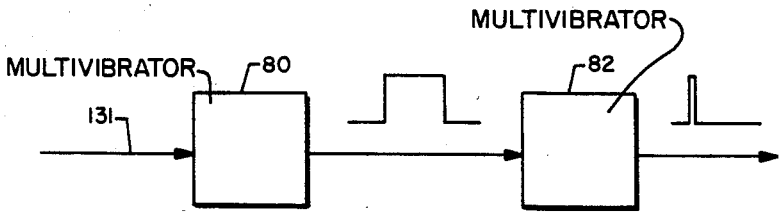
FIG. 8 is a block diagram of means 62 of FIG. 6.

Block 62 which functionally selects the first of the differentiated pulses from differentiator 60 is shown in FIG. 8, and comprises a pair of monostable multivibrators 80 and 82. The differentiated output from differentiator 60 is applied to a first monostable multivibrator 80 which has a time delay of a length somewhat longer than the period from the first to the last pulse of waveform B of FIG. 5. Thus, monostable multivibrator 80 will be triggered on the first pulse from the differentiator 60 and will provide a pulse of width longer than that of the 3 differentiated pulses. This relatively long pulse is applied to a second monostable multivibrator 82 which is triggered on the leading edge of the pulse from monostable multivibrator 80, and it has a relatively short time delay to provide the pulse shown in waveform C of FIG. 5.

The canard reference pulses, that is, the pulses illustrated in waveform D of FIG. 5, are generated by, for example, the mechanism shown in FIG. 9. A magnetic pickup 84 provides an output which is applied to a monostable multivibrator 86 to buffer the relatively noisy output of a pickup to provide the reference pulse. An electro Model 3080 can be employed as the magnetic pickup. This item is manufactured by Electric Corp. 1845 57St., Sarasota, Fla.

The outputs from monostable multivibrators 86 and 82 are applied to comparator 64, which is illustrated in detail in FIG. 10. The output from the comparator 64 is proportional to any misalignment between the fixed canards and the targets and provides a signal to properly orient the fixed canards to the target.

The output from monostable multivibrator 82 is applied to input 88 of the comparator and the output from monostable multivibrator 86 is applied to input 90 of the comparator. The selected first differentiated pulse is applied to a resettable integrator 92, which output is applied to a sample and hold circuit 94. The reference pulse from input 90 is used to enable sample and hold circuit 94. Therefore, the first reference pulse after the selected differentiated pulse will cause circuit 94 to sample and hold the value of the resettable integrator 92. In like fashion, the reference pulse will be applied to a resettable integrator 96, which output is applied to a sample and hold circuit 98. Sample and hold circuit 98 will sample the value in resettable integrator 96 upon being enabled by the selected first differential pulse. The integrators 92 and 96 are reset by pulses from monostable vibrators 100 and 102, which have a delay equal to 100 ns.

The values stored in sample and hold circuits 94 and 98 are applied to a summer 104 wherein the value in sample and hold circuit 98 is subtracted from the value in sample and hold circuit 94 providing an output 106 which is proportional to target to canard displacement. In one embodiment the resettable integrators may be of the circuit types illustrated by Burr Brown 4013/25, manufactured by Burr-Brown Research Corporation, International Airport, Industrial Park, Tucson, Ariz., and the sample and hold circuits may be of the type illustrated by Analog Devices SHH-18 manufactured by Analog Devices P.O. Box 280, Norwood, Mass.

The alternator winding 16 and its associated circuit is illustrated in greater detail in FIG. 11. The output from the alternator 16 is applied via a transformer 108 to a full wave rectifier 110. A variable load 112 is coupled to the output of full wave rectifier 110. The load is varied through amplifier 114 having a feedback path 116 from the variable load. Amplifier 114 may be of the type illustrated by an Inland EM-1802 manufactured by Inland Motor, Radford, Va. The output from summer 104 of the comparator in FIG. 10 is applied to the input to amplifier 114 to vary the load. Changing the load on the windings changes the torque on the armature which, thus, reorientates the canard frame with respect to the main housing.

Block 63 of FIG. 6 is illustrated in block diagram format in FIG. 12. The differentiated signal applied on line 129 (see waveform B of FIG. 5) is integrated in an integrator 120 to provide a series of pulses which are limited by a limiter 122 to ensure that the amplitudes of all pulses are equal. The output from limiter 122 is applied to an integrator 124 which output is a voltage proportional to the sum of the six pulse widths from integrator 120. The output from integrator 124 is held in a sample and hold circuit 126. This held value is directly proportional to the magnitude of the angle difference between the center line of the projectile (spin axis) and the line-of-sight to the target.

Integrator 124 is reset by an input thereto provided by a target reference pulse (see waveform C of FIG. 5) applied along a line 128. The sample and hold circuit 126 is enabled by an output from monostable multivibrator 130. having a delay time equal to the period of the six pulses sensor output pulses. Multivibrator 130 is also triggered by the target reference pulse.

The fuzing and safing and arming for the device may be any of these available and no invention lies in any particular fuzing or safing and arming scheme.

While the present invention has been described in relation to a particular reticle design, other reticles may be employed in a sensing system requiring neither gimbals nor a reticle motor. Thus, it is to be understood that the embodiments shown are illustrative only and that many variations and modifications may be made without departing from the principles of the invention herein disclosed and defined by the appended claims.

We claim:

1. In combination with a spinning projectle, an infrared target seeker connected to the spinning projectile for rotation thereof, comprising:

a plurality of lenses;

a reticle etched on one of said lenses; and a photocell detector, said lenses, reticle and detector forming a solid unit having no air gaps between components.

2. Apparatus as recited in claim 1, wherein said detector includes two layers for operation in distinct wavelength bands.

3. Apparatus as recited in claim 1, wherein said reticle includes two semicircular portions.

4. Apparatus as recited in claim 3, wherein a first of said semicircular portions is semitransparent.

5. Apparatus as recited in claim 3, wherein a second of said semicircular portions includes a radial encoding design.

6. Apparatus as recited in claim 5, wherein said radial encoding design comprises transparent spokes equally disposed on an opaque background such that increasing amounts of the said second semicircular portion of the reticle are transparent towards the center of said reticle.

* * * * *